US010355409B2

(12) United States Patent
Peterson et al.

(10) Patent No.: US 10,355,409 B2
(45) Date of Patent: Jul. 16, 2019

(54) WIRING-HARNESS WITH CONNECTOR STAGING DEVICE

(71) Applicant: Aptiv Technologies Limited, St. Michael (BB)

(72) Inventors: David R. Peterson, Aurora, OH (US); Joseph Sudik, Jr., Niles, OH (US); Frank Walter Szuba, Jr., El Paso, TX (US); Mark Intihar, San Jose, CA (US); Benjamin Decker, San Jose, CA (US); Andrew Kneppers, San Jose, CA (US)

(73) Assignee: APTIV TECHNOLOGIES LIMITED (BB)

( * ) Notice: Subject to any disclaimer, the term of this patent is extended or adjusted under 35 U.S.C. 154(b) by 0 days.

(21) Appl. No.: 15/634,268

(22) Filed: Jun. 27, 2017

(65) Prior Publication Data

US 2018/0375256 A1 Dec. 27, 2018

(51) Int. Cl.
*H01R 43/20* (2006.01)
*H01R 13/631* (2006.01)
*H01R 13/60* (2006.01)

(52) U.S. Cl.
CPC ..... *H01R 13/631* (2013.01); *H01R 13/60* (2013.01); *H01R 43/20* (2013.01); *H01R 2201/26* (2013.01)

(58) Field of Classification Search
CPC .... B60R 16/0207; H01R 43/20; H01R 13/426
USPC ..... 439/552, 553, 528
See application file for complete search history.

(56) References Cited

U.S. PATENT DOCUMENTS 3,917,202 A * 11/1975 Reinwall, Jr. ..... H01R 9/26 174/72 A
5,123,721 A * 6/1992 Seo ..... G06F 1/184 312/333
5,964,617 A 10/1999 Hoang et al.
6,083,041 A * 7/2000 Kuo ..... H01R 13/741 439/553
6,095,855 A * 8/2000 Iwata ..... H01R 13/6273 439/34
6,206,731 B1 * 3/2001 Kuo ..... H01R 13/741 439/553
6,290,536 B1 * 9/2001 Hwang ..... H01R 13/631 439/378

(Continued)

FOREIGN PATENT DOCUMENTS

AU 8399175 A 2/1977
JP 4-61873 U1 5/1992

(Continued)

*Primary Examiner* — Briggitte R. Hammond
(74) *Attorney, Agent, or Firm* — Joseph Victor Bonadies

(57) ABSTRACT

A wiring-harness includes an electrical-connector and a staging-device. The staging-device has a cavity defining a flexible-member in compressive contact with the electrical-connector. The flexible-member is configured to removably retain the electrical-connector within the cavity. The cavity locates the electrical-connector in a predetermined-position within the staging-device, such that the electrical-connector is presented to an assembler in the predetermined-position. The staging-device is particularly useful in automated, i.e. robotic, installation of the wiring-harness.

20 Claims, 4 Drawing Sheets

(56) References Cited

U.S. PATENT DOCUMENTS

| | | | | |
|---|---|---|---|---|
| 6,325,652 | B1 * | 12/2001 | Grant | H01R 13/6315 439/248 |
| 7,614,897 | B2 * | 11/2009 | Lopez | H01R 13/516 439/248 |
| 8,689,436 | B2 * | 4/2014 | Hofmann | G01R 1/0425 29/759 |
| 2007/0246241 | A1 * | 10/2007 | Peterson | H01R 4/185 174/74 R |

FOREIGN PATENT DOCUMENTS

| | | | | |
|---|---|---|---|---|
| JP | 7130449 | A | | 5/1995 |
| JP | 7-326236 | A | | 12/1995 |
| JP | 8298024 | A | | 11/1996 |
| JP | 2001163126 | A | * | 6/2001 |
| JP | 2002-198152 | A | | 7/2002 |

* cited by examiner

WIRING-HARNESS WITH CONNECTOR STAGING DEVICE

TECHNICAL FIELD OF INVENTION

This disclosure generally relates to a wiring-harness, and more particularly relates to a wiring-harness having an electrical-connector staging-device.

BACKGROUND OF INVENTION

The typical vehicle wiring-harness may be several meters in length and may contain multiple branches that interconnect electrical components to electrical power and/or computer controllers. The multiple wiring-harness branches typically terminate with electrical-connectors that may be temporarily attached to the wiring-harness with adhesive tape, or other temporary attachment methods, to protect the electrical-connectors during unpacking and handling. Removal of the adhesive tape in a vehicle assembly plant is required before the wiring-harness is installed into the vehicle, and may typically be performed by a human during the installation process.

As assembly vehicle processes are increasingly automated, there may be a desire to use a robotic installer for installing a wire harness within the vehicle. However, in order to do this, a robotic assembler must be able to consistently located the multiple connectors on the harness and remove the adhesive tape. These are both fairly complex operations for a robot.

Therefore, a vehicle wiring-harness that is configured to be more easily handled by a robotic installer remains desired.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

SUMMARY OF THE INVENTION

In accordance with one embodiment, a wiring-harness is provided. The wiring-harness includes a wire-cable having an electrical-connector and a staging-device. The staging-device has a cavity defining a flexible-member in compressive contact with the electrical-connector. The flexible-member is configured to removably retain the electrical-connector within the cavity. The cavity locates the electrical-connector in a predetermined-position within the staging-device, such that the electrical-connector is presented to an assembler, e.g. a robot, in the predetermined-position.

The flexible-member may be a arcuate flexible-beam that is integrally formed with the staging-device.

The flexible-member may be a quarter-round ribbed-spacer that is formed of a complaint material different from a material forming the staging-device, and is disposed within a corner of the cavity. The flexible-member may be secured to the staging-device by a T-shaped rail defined by the flexible-member that is disposed within a corresponding T-shaped-cavity defined by the staging-device.

At least thirty percent of a surface-area of the electrical-connector may be disposed within the cavity.

The electrical-connector may be located with a true-position of less than 2.0 millimeters relative to the predetermined-position, and preferably with the true-position of less than 0.5 millimeter relative to the predetermined-position.

Each cavity may include at least four datum-surfaces. The four datum-surfaces are configured to contact the electrical-connector disposed within the cavity on at least four corresponding datum-points. The at least four corresponding datum-points on the electrical-connector may include a first-side, a second-side, a third-side, and a mating-side. Alternatively, the at least four corresponding datum-points on the electrical-connector may include a first-side, a second-side, a mating-side, and a corner.

The flexible-member may apply a retention-force to the electrical-connector within the cavity in a range from about 40 Newtons to about 60 Newtons.

In another embodiment, a staging-device configured to retain an electrical-connector of a wiring harness is provided. The staging-device includes a staging-device-body and a flexible-member. The staging-device-body defines a cavity. The flexible-member is configured to be in compressive contact with the electrical-connector when inserted within the cavity. The flexible-member is configured to removably retain the electrical-connector within the cavity. The cavity locates the electrical-connector in a predetermined-position within the staging-device such that the electrical-connector is presented to an assembler in the predetermined-position.

The flexible-member may be a arcuate flexible-beam that is integrally formed with the staging-device.

The flexible-member may be a quarter-round ribbed-spacer.

At least thirty percent of a surface-area of the electrical-connector may be disposed within the cavity.

The electrical-connector may be located with a true-position of less than 2.0 millimeters relative to the predetermined-position.

Further features and advantages will appear more clearly on a reading of the following detailed description of the preferred embodiment, which is given by way of non-limiting example only and with reference to the accompanying drawings.

BRIEF DESCRIPTION OF DRAWINGS

The present invention will now be described, by way of example with reference to the accompanying drawings, in which.

The reference numbers of similar elements in the various embodiments shown in the figures share the last two digits.

DETAILED DESCRIPTION

Figure 1:
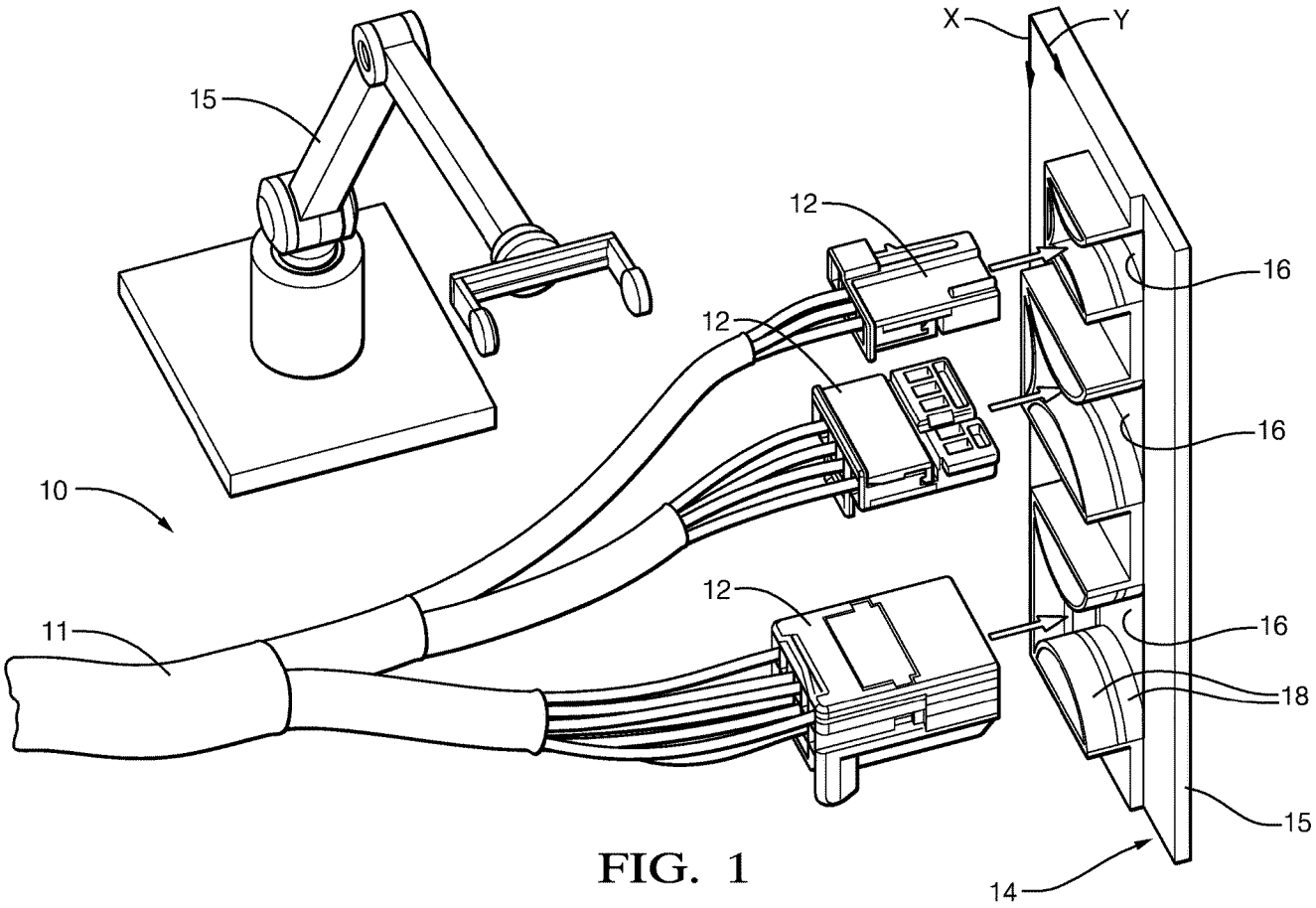
FIG. 1 is an illustration of a wiring-harness with a staging-device in accordance with an embodiment of the invention.

FIG. 1 illustrates a non-limiting example of a wiring-harness 10, suitable for use in a vehicle (not shown). As will be described in more detail below, the wiring-harness 10 is an improvement over prior wiring harnesses because the wiring-harness 10 is configured to present the wiring-harness 10 to an assembler (e.g. a robot 15 or other automated assembly process) in a repeatable and reproducible manner. The wiring-harness 10 includes a wire-cable 11 having an electrical-connector 12 configured to mate with a corresponding electrical-connector (not shown) that may be attached to an electrical-component on the vehicle. The wiring-harness 10 may have a plurality of wire-cables 11 containing a plurality of electrical-connectors 12, as will be evident to those skilled in the art. The plurality of electrical-connectors 12 may be of a same design, or may be of a differing designs with different dimensions.

The wiring-harness 10 includes a staging-device 14 having a staging-device-body 15 that defines a cavity 16. The cavity 16 defines a flexible-member 18 in compressive contact with the electrical-connector 12 (see FIGS. 2A-2B). The staging-device 14 may include a single cavity 16, or may include a plurality of cavities 16 to retain the plurality of electrical-connectors 12, as illustrated in FIG. 1. The staging-device 14 may be attached to the wiring-harness 10, or may be attached to a wiring-conduit (not shown) in which the wiring-harness 10 may be disposed, or may be a stand-alone device. The flexible-member 18 is configured to removably retain the electrical-connector 12 within the cavity 16 while the wiring-harness 10 is removed from a shipping container and staged for installation onto the vehicle.

Figure 2A:
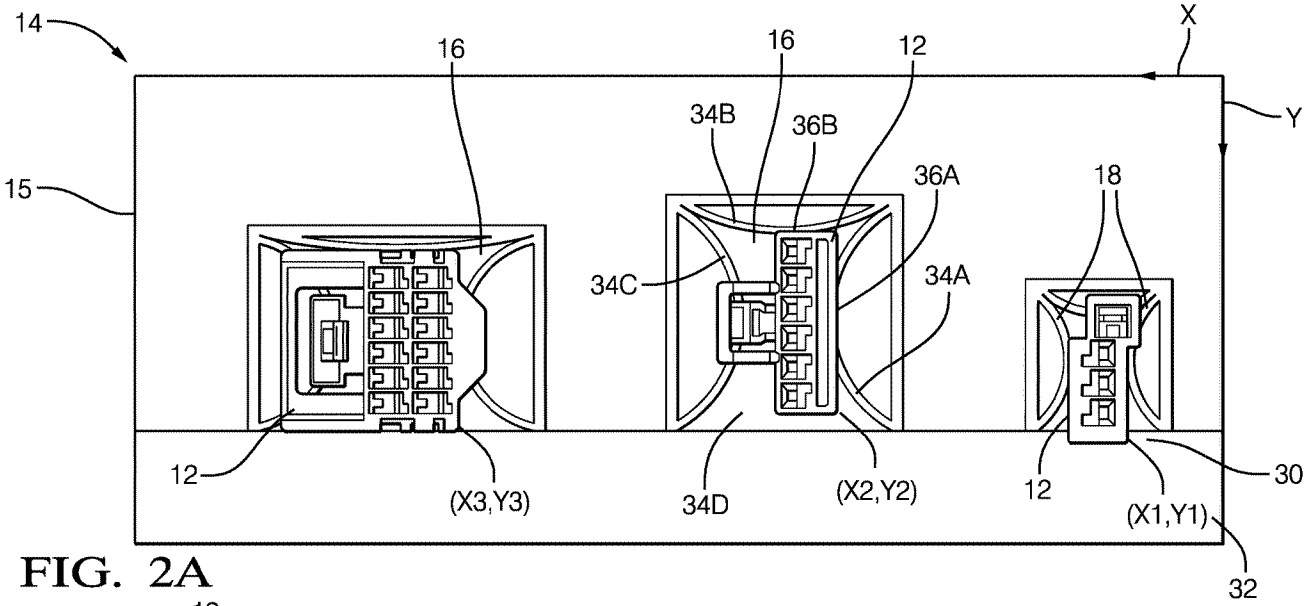
FIG. 2A is an illustration of a top-view of the staging-device of FIG. 1 in accordance with an embodiment of the invention.
Figure 2B:
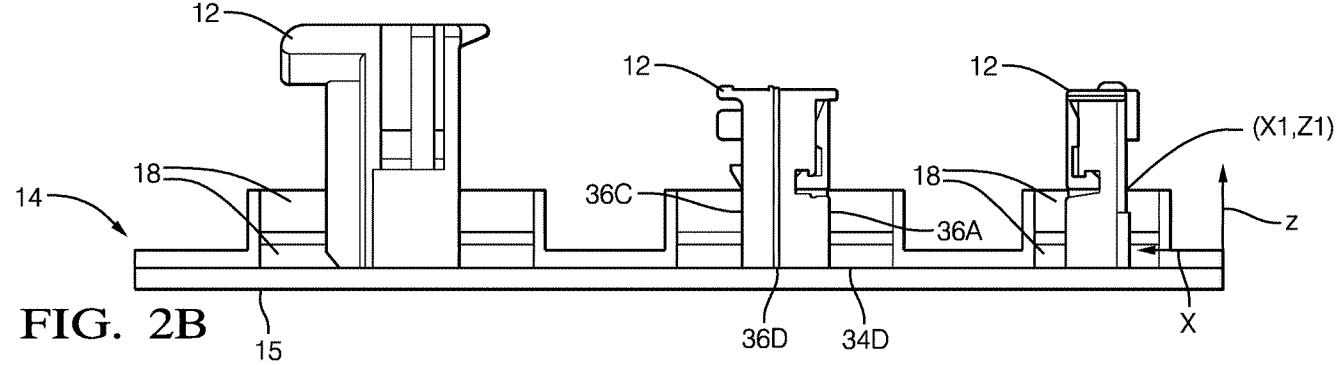
FIG. 2B is an illustration of a front-view of the staging-device of FIG. 1 in accordance with an embodiment of the invention.

FIGS. 2A-2B illustrate a top-view and a front-view, respectively, of the staging-device 14. The wiring-harness 10 is removed from FIGS. 2A-2B for purposes of clarity. The flexible-member 18 may be a arcuate flexible-beam 20 that is integrally formed with the staging-device 14. The arcuate flexible-beam 20 may have an upper-portion and a lower-portion that may be separated by a gap. The arcuate flexible-beam 20 may be integrally formed with the staging-device 14, or may be removable and replaceable.

Figure 3B:
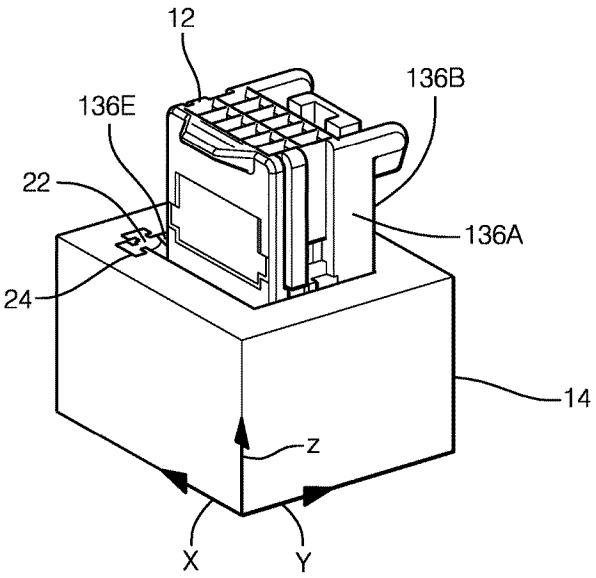
FIG. 3B is an illustration of a perspective-view of the cavity, the flexible-member, and the electrical-connector of FIG. 3A in accordance with an embodiment of the invention.
Figure 3A:
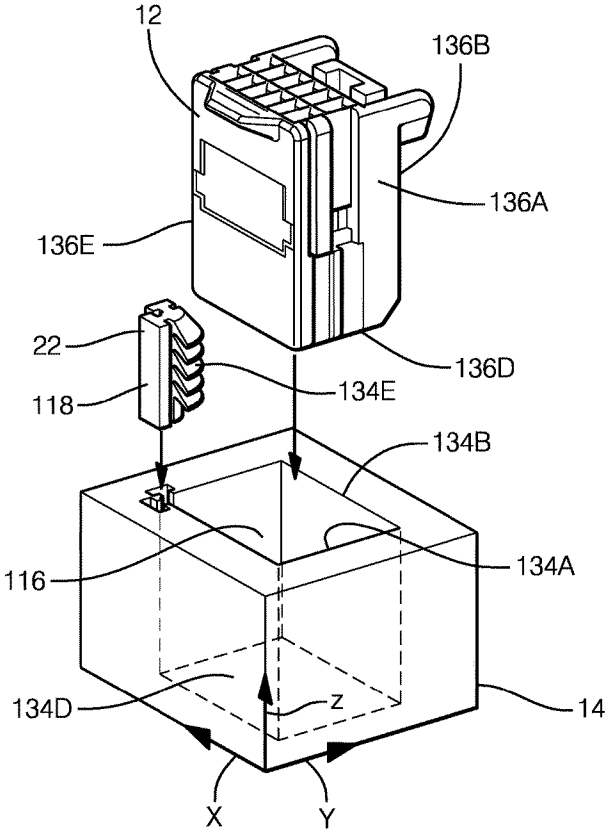
FIG. 3A is an illustration of an exploded-view of a cavity, a flexible-member, and an electrical-connector in accordance with an embodiment of the invention.
Figure 4B:
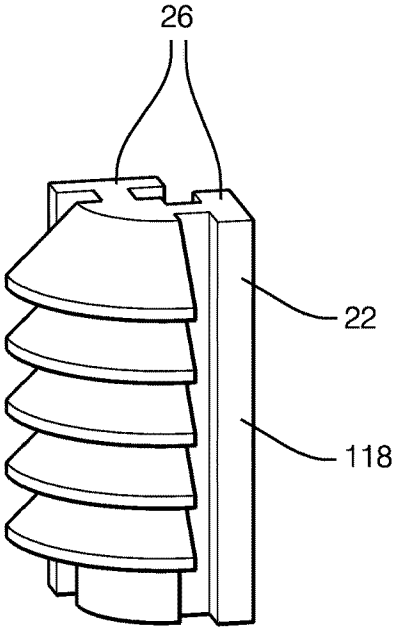
FIG. 4B is an illustration of the flexible-member of FIGS. 3A-3B in accordance with an embodiment of the invention.
Figure 4A:
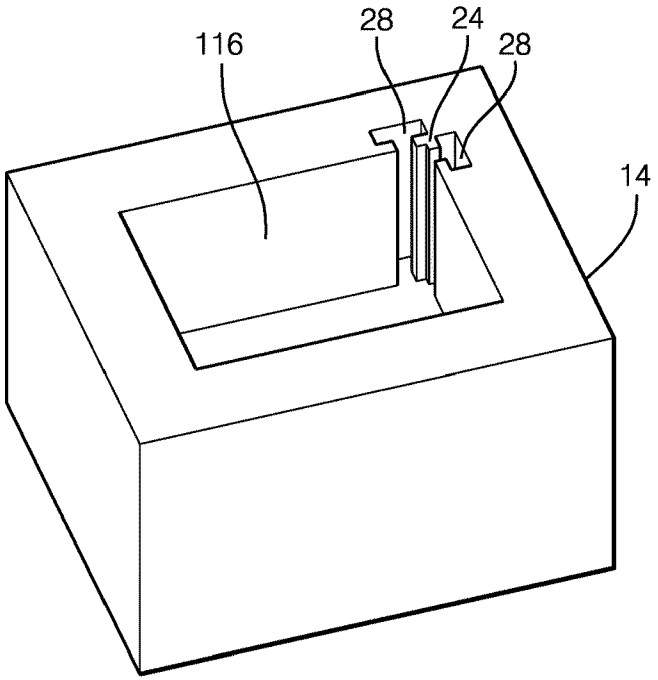
FIG. 4A is an illustration of the cavity of FIG. 3A in accordance with an embodiment of the invention.

FIGS. 3A-3B illustrate another embodiment of a cavity 116 and a flexible-member 118 that is a quarter-round ribbed-spacer 22. A "ribbed-spacer" is commonly referred to as a "fir-tree", "pine-tree", and/or a "Christmas-tree" type of fastener, all of which may be included as the flexible-member 118. The individual ribs of the quarter-round ribbed-spacer 22 may be perpendicular to the shank or may be angled to the shank to provide an insertion lead-in for the electrical-connector 12. The flexible-member 118 (i.e. the quarter-round ribbed-spacer 22) may be formed of a complaint material different from a material forming the staging-device 14. The quarter-round ribbed-spacer 22 may be disposed within a corner 24 of the cavity 116. The quarter-round ribbed-spacer 22 may be secured to the staging-device 14 by a T-shaped rail 26, defined by the flexible-member 118, that is disposed within a corresponding T-shaped-cavity 28 defined by the staging-device 14, as illustrated in FIGS. 4A-4B. A radius of the flexible-member 118 may be varied to accommodate the electrical-connectors 12 with various dimensions without changing a dimension of the cavity 116. While the flexible-member 118 illustrated in FIGS. 3A-4B is described as having a "quarter-round" shape, other shapes are envisioned, but not shown, that may accommodate a contour of the electrical-connector 12. This feature is beneficial because the cavity 116 may be of a standard dimension, whereas the flexible-member 118 may be fabricated to differing shapes and dimensions to retain electrical-connectors 12 of varying dimensions.

Returning now to FIGS. 2A-2B, the cavity 16 locates 30 the electrical-connector 12 in a predetermined-position 32 within the staging-device 14, such that the electrical-connector 12 is presented to the assembler in the predetermined-position 32. The location 30 of the electrical-connector 12, relative to an X-axis, a Y-axis, and a Z-axis of the staging-device 14 may be presented to the assembler in advance of the assembly process (i.e. downloaded into a computer memory—not shown), or may be encoded on the staging-device 14 in the form of a radio-frequency transmitter, or a bar code or other indicia (not shown) to be read by a vision system (not shown) included in the assembler.

Preferably, at least thirty percent (30%) of a surface-area of the electrical-connector 12 is disposed within the cavity 16 to maintain an alignment of the electrical-connector 12. The electrical-connector 12 is preferably located 30 with a true-position of less than 2.0 millimeters (2.0 mm) relative to the predetermined-position 32, and more preferably located 30 with the true-position of less than 0.5 mm. As used herein, the true-position is an allowable tolerance window surrounding the predetermined-position 32 in which the location 30 of the electrical-connector 12 may exist.

Each cavity 16 of the staging-device 14 may include at least four datum-surfaces 34, illustrated in FIGS. 2A-2B as datum-surfaces 34A-34D, that are configured to contact the electrical-connector 12 disposed within the cavity 16 on at least four corresponding datum-points 36, illustrated in FIGS. 2A-2B as corresponding datum-points 36A-36D. The four corresponding datum-points 36 on the electrical-connector 12 include a first-side 36A, a second-side 36B adjacent to the first-side 36A, a third-side 36C opposite the first-side 36A, and a mating-side 36D or terminal-end of the electrical-connector 12 that lies in a plane perpendicular to the Z-axis of the staging-device 14. One skilled in the art of will recognize that the corresponding datum-points 36 may contact the datum-surfaces 34 anywhere on the datum-surface 34, and may vary due to part-to-part dimensional variation. In other words, the exact point of contact between the corresponding datum-point 36 and the datum-surface 34 may vary.

For the specific example of the cavity 116 with the quarter-round ribbed-spacer 22 illustrated in FIGS. 3A-3B, the cavity 116 also includes at least four datum-surfaces 134, illustrated as datum-surfaces 134A-134B and 134D-134E, and at least four corresponding datum-points 136 on the electrical-connector 12 illustrated as datum-points 136A-136B and 136D-136E. The at least four corresponding datum-points 136 include a first-side 136A, a second-side 136B adjacent to the first-side 136A, a mating-side 136D or terminal-end that lies in a plane perpendicular the Z-axis of the staging-device 14, and an edge 136E opposite an intersection of the first-side 136A with the second-side 136B.

Returning again to FIGS. 2A-2B, the flexible-member 18 applies a retention-force (not shown) to the electrical-connector 12 within the cavity 16 in a range from about 40 Newtons (40 N) to about 60 N. This retention-force is sufficient to retain the electrical-connector 12 within the cavity 16 during shipping and handling and ensures the electrical-connector 12 is located 30 at the predetermined-position 32 until the assembler removes the electrical-connector 12 from the staging-device 14.

The examples presented herein are directed to electrical-cables. However, other embodiments of the staging-device 14 may be envisioned that are adapted for use with optical-cables or hybrid-cables including both electrical and optical-cables. Yet other embodiments of the staging-device 14, may be envisioned that are configured for installing pneumatic or hydraulic lines.

Accordingly, a wiring-harness 10 and a staging-device 14 for the wiring-harness 10 is provided. The wiring-harness 10 is beneficial because it is configured to present the electrical-connector 12 to the assembler (e.g. a robot 15 or other automated assembly process) in the predetermined-position 32, which reduces an installation time required to install the wiring-harness 10 onto the vehicle and allowing easier automation of the installation process since removal of adhesive tape is no longer required to secure the connectors.

While this invention has been described in terms of the preferred embodiments thereof, it is not intended to be so limited, but rather only to the extent set forth in the claims that follow. Moreover, the use of the terms first, second, upper, lower, etc. does not denote any order of importance, location, or orientation, but rather the terms first, second, etc. are used to distinguish one element from another. Furthermore, the use of the terms a, an, etc. do not denote a limitation of quantity, but rather denote the presence of at least one of the referenced items.

We claim:

1. A wiring-harness assembly, comprising:

a wire-cable having at least one electrical-connector; and a staging-device defining at least one cavity, said staging-device comprising at least one flexible-member disposed within the at least one cavity in compressive contact with the at least one electrical-connector;

said at least one flexible-member configured to removably retain the at least one electrical-connector within the at least one cavity;

said staging-device locates the at least one electrical-connector in a predetermined-position within the at least one cavity, such that the at least one electrical-connector is presented to an assembler in the predetermined-position;

said staging-device is configured to release the at least one electrical-connector from the predetermined-position to the assembler; wherein the at least one electrical-connector is located with a true-position of less than 2.0 millimeters relative to the predetermined-position.

2. The wiring-harness assembly in accordance with claim 1, wherein the at least one flexible-member is a arcuate flexible-beam.

3. The wiring-harness assembly in accordance with claim 2, wherein the arcuate flexible-beam is integrally formed with the staging-device.

4. The wiring-harness assembly in accordance with claim 1, wherein between thirty percent and fifty percent of a surface-area of the at least one electrical-connector is disposed within the at least one cavity.

5. The wiring-harness assembly in accordance with claim 1, wherein the at least one electrical-connector is located with the true-position of less than 0.5 millimeter relative to the predetermined-position.

6. The wiring-harness assembly in accordance with claim 1, wherein the at least one cavity includes at least four datum-surfaces, said four datum-surfaces configured to contact the at least one electrical-connector disposed within the at least one cavity on at least four corresponding datum-points.

7. The wiring-harness assembly in accordance with claim 6, wherein the at least four corresponding datum-points on the at least one electrical-connector include a first-side, a second-side, a third-side, and a mating-side.

8. The wiring-harness assembly in accordance with claim 1, wherein the at least one flexible-member applies a retention-force to the at least one electrical-connector within the at least one cavity in a range from about 40 Newtons to about 60 Newtons.

9. The wiring-harness assembly in accordance with claim 1, wherein the assembler is a robot.

10. A staging-device configured to retain at least one electrical-connector of a wiring-harness, said staging-device comprising:

a staging-device-body defining at least one cavity; and at least one flexible-member configured to be in compressive contact with the at least one electrical-connector when inserted within the at least one cavity;

said at least one flexible-member configured to removably retain the at least one electrical-connector within the at least one cavity;

said staging-device-body configured to locate the at least one electrical-connector in a predetermined-position within the at least one cavity such that the at least one electrical-connector is presented to an assembler in the predetermined-position;

said staging-device-body further configured to release the at least one electrical-connector from the predetermined-position to the assembler; wherein the staging-device-body is configured to locate the at least one electrical-connector with a true-position of less than 2.0 millimeters relative to the predetermined-position.

11. The staging-device in accordance with claim 10, wherein the at least one flexible-member is a arcuate flexible-beam.

12. The wiring harness assembly in accordance with claim 11, wherein the arcuate flexible beam includes a first end and a second, said first end and second end fixed to the staging-device.

13. The staging-device in accordance with claim 11, wherein the arcuate flexible-beam is integrally formed with the staging-device-body.

14. The staging-device in accordance with claim 11, wherein the arcuate flexible-beam comprises an upper-portion and a lower-portion.

15. The staging-device in accordance with claim 14, wherein the upper-portion and lower lower-portion are separated by a gap.

16. The staging-device in accordance with claim 10, wherein the staging-device is configured to locate the at least one electrical-connector with a true-position of less than 0.5 millimeter relative to the predetermined-position.

17. The staging-device in accordance with claim 10, wherein the at least one flexible-member applies a retention-force to the at least one electrical-connector within the at least one cavity in a range from about 40 Newtons to about 60 Newtons.

18. The wiring-harness assembly in accordance with claim 2, wherein the arcuate flexible-beam comprises an upper-portion and a lower-portion.

19. The wiring-harness assembly in accordance with claim 18, wherein the upper-portion and the lower-portion are separated by a gap.

20. The wiring harness assembly in accordance with claim 2, wherein the arcuate flexible beam includes a first end and a second, said first end and second end fixed to the staging-device.

* * * * *